US005625920A

United States Patent [19]

Bores et al.

[11] Patent Number: 5,625,920

[45] Date of Patent: May 6, 1997

[54] CLEANING TOOL WITH STORABLE BRUSH

[75] Inventors: Frederick M. Bores, Highlands Ranch; Dan Venard, Littleton; Michael Guest, Denver, all of Colo.

[73] Assignee: Windsor Industries, Inc., Englewood, Colo.

[21] Appl. No.: 550,950

[22] Filed: Oct. 31, 1995

[51] Int. Cl.[6] ..... A47L 9/06

[52] U.S. Cl. ..... 15/322; 15/373; 15/400

[58] Field of Search ..... 15/321, 322, 368, 15/373, 393, 398, 400; 239/528

[56] References Cited

U.S. PATENT DOCUMENTS

| | | | |
|---|---|---|---|
| 1,474,875 | 11/1923 | Adams | 15/400 |
| 2,012,287 | 8/1935 | Replogle et al. | 15/158 |
| 2,047,677 | 7/1936 | Edstrom | 15/373 |
| 2,671,925 | 3/1954 | Gerber | 15/373 |
| 2,674,002 | 4/1954 | White | 15/400 |
| 2,851,717 | 9/1958 | Kasper | 15/360 |
| 4,485,518 | 12/1984 | Kasper | 15/322 |
| 4,597,124 | 7/1986 | Williams, III et al. . | |
| 4,651,929 | 3/1987 | Kranzle | 239/526 |
| 4,893,375 | 1/1990 | Girman et al. | 15/322 |
| 4,909,443 | 3/1990 | Takagi | 239/526 |
| 4,910,828 | 3/1990 | Blase et al. | 15/322 |
| 5,054,159 | 10/1991 | Richardson | 15/400 |
| 5,311,638 | 5/1994 | Furcron et al. | 15/322 |
| 5,341,541 | 8/1994 | Sham . | |

*Primary Examiner*—David Scherbel
*Assistant Examiner*—Terrence R. Till
*Attorney, Agent, or Firm*—Sheridan Ross P.C.

[57] ABSTRACT

A cleaning tool is disclosed that includes a brush unit having bristles that is positionable in each of a selected one of a cleaning position and a storage position. In the cleaning position, the brush bristles contact the surface being cleaned using the tool. In the storage position, the brush bristles face in a different direction from the cleaning position and do not contact any surface being cleaned. The tool includes an attachment member for receiving the brush unit. In order to change the position of the brush unit, it is removed from remaining parts of the tool and rotated or otherwise changed in position before re-joining it to the attachment member. In changing between cleaning and storage positions, the ends of the brush unit are disposed at opposite ends of the attachment member. Preferably, the cleaning tool includes a spray control assembly for controlling the spraying of a liquid cleaner during use of the cleaning tool. The spray control assembly includes first and second locking assemblies for selectively preventing and enabling, respectively, such spraying while the tool is being used.

14 Claims, 6 Drawing Sheets

CLEANING TOOL WITH STORABLE BRUSH

FIELD OF THE INVENTION

The present invention relates to a tool for cleaning and, in particular, to a cleaning tool held in the hand of the user and having a brush that is locatable in a cleaning position and a storage position.

BACKGROUND OF THE INVENTION

Numerous cleaning devices have been devised for engaging a surface to be cleaned. Some of these devices are held by the hand of the user or operator adjacent the end of the device through which dirt or other debris are drawn into the device. The device is commonly connected to a source of negative pressure for drawing in the debris. In one group of hand cleaning devices, a spray nozzle is part thereof and sprays a liquid cleaning solution on the surface as it is being cleaned.

Some of these hand held cleaning devices include a brush that is held to the tool adjacent its mouth or open end. During cleaning, the operator of the device can manipulate the brush to assist in dislodging or otherwise preparing the floor surface for removal of the debris as the device moves thereacross. These surfaces can include upholstery or wall surfaces that have a fabric or other material joined thereto. As the hand held device is moved across such a wall surface, the brush can be used to lift or disengage debris from the surface so that it can be better drawn in by the vacuum produced in the device. It is also known to be able to change the position of the brush. In a first position, the brush bristles are readily able to contact the surface being cleaned. In a second position, the brush and its bristles are located at a distance from the end of the device so that the brush bristles would not contact the surface when the end is moving over the surface. Even though movable brushes have been devised or proposed for use with hand held cleaning devices, certain advancements would be advantageous. In that regard, a hand held cleaning tool that has a reduced number of parts, incorporates convenient storage of the brush, and where the brush is readily adapted to a cleaning position and a storage position would be highly beneficial.

SUMMARY OF THE INVENTION

In accordance with the present invention, a cleaning tool is provided that includes a cleaning brush unit that is connectable adjacent to the head of the tool. In a cleaning position, the brush unit has bristles that are located near the mouth or open end of the head. When the user moves the tool, the brush bristles contact the surface being cleaned to assist in the cleaning process. In a storage position, the brush bristles face in a different direction and do not contact the surface being cleaned when the user is moving the head of the tool across such a surface.

The cleaning brush unit includes a base member that has one or more holes for receiving and holding the brush bristles. A connector is joined to the base member and is disposed at a predetermined angle relative to the base member. This predetermined angular relationship is necessary in achieving the desired cleaning and storage positions of the brush unit. A seat or female member is joined to the connector. The seat member has first and second projections and an interconnector therebetween. With respect to connecting the cleaning brush unit near the tool head, an attachment or male member extends outwardly from the tool. This attachment member includes longitudinally extending converging walls. The seat member receives the attachment member between its first and second projections to hold the cleaning brush unit in a selected one of two positions.

In describing a first or cleaning position of the cleaning brush unit when it is being used to clean a surface, the seat member can be defined as having first and second ends and the attachment member can be defined as having first and second ends. In the cleaning position, the first end of the seat member is located adjacent to the first end of the attachment member. Conversely, in a second or storage position, the first end of the seat member is located adjacent to the second end of the attachment member.

Regarding the changing of the cleaning brush unit position, it is removed from the attachment member. This is accomplished by sliding the seat member relative to the attachment member. After removal, the brush unit is turned or rotated, preferably about 180° from the previous position it had while being held by the attachment member. Once this relative change in position of the brush unit is completed, the seat member is placed at one end of the attachment member and the operator or user slides the seat member relative to the attachment member. In the storage position, the brush bristles are disposed away from any surface that the tool is then cleaning.

In a preferred embodiment of the invention, the tool includes a housing of a single unit construction and a flow control assembly for enabling the user or operator to control the application of a liquid cleaner in the form of a spray to the surface being cleaned. This construction is formed with a number of fluid passages or pathways. The flow control assembly has three operative states. In the first state, the operator controls whether or not liquid spray is applied to the surface being cleaned. In the second state or "lock off," no liquid spray exits the head of the tool. In the third state or "lock on," a liquid in the form of a spray is supplied to the surface being cleaned by the tool. Preferably, the flow control assembly includes a first locking assembly for holding the flow control assembly in the second state ("lock off") so that the operator can hold the tool while cleaning the surface without causing liquid to be sprayed on the surface and a second locking assembly for holding the flow control assembly in the third state ("lock on") so that the operator can hold the tool while cleaning the surface and with liquid being sprayed on the surface without the operator exercising any control over the outputting of the spray from the tool.

Based on the foregoing summary, a number of worthwhile aspects of the present invention can be readily identified. A cleaning tool is provided with a removable brush unit that permits changing between a cleaning position and a storage position. When the brush unit is in the cleaning position, it is readily able to contact the cleaning surface to assist in the removal of debris and, while in the storage position, the brush bristles do not contact the surface being cleaned. Limited parts are required to achieve each of the selected new positions. In a straightforward manner, the brush unit can be slid from the attachment member, turned around or rotated, and then rejoined to the attachment member in order to change between cleaning and storage positions on the tool. Furthermore, the tool of the present invention includes a flow control assembly that facilitates the spraying of a cleaning liquid to the surface being cleaned. Locking assemblies enable the operator to select "lock off" or "lock on" states to control the release of a liquid spray. A tool housing is provided that is a one-piece construction to further limit the number of parts while still providing the necessary fluid passages for vacuum drawn debris and liquid spray.

Additional advantages of the present invention will become readily apparent from the following discussion, particularly when taken together with the accompanying drawings.

DETAILED DESCRIPTION

Figure 1:
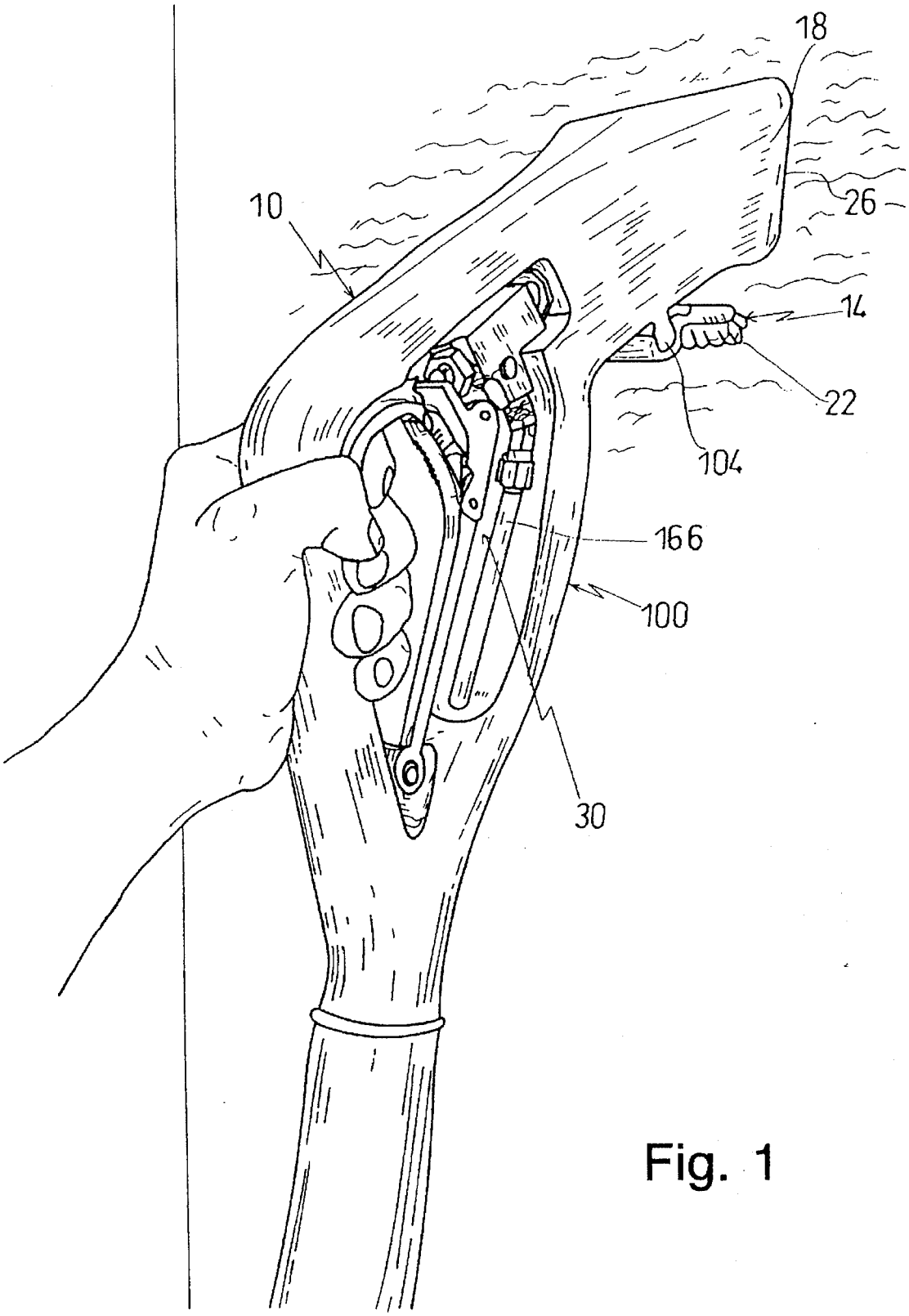
FIG. 1 is a perspective view of the tool of the present invention illustrating its use in cleaning a wall surface.

With reference to FIG. 1, a cleaning accessory tool 10 is disclosed for cleaning surfaces, including upholstery and/or wall surfaces that have a fabric disposed thereon. The tool 10 includes a cleaning brush unit 14 held to remaining portions of the tool 10 near the head 18 of the tool 10. The brush unit 14 has a number of bristles 22 that are positioned to engage the surface, such as the fabric, as the tool is moved relative to the surface being cleaned. In one embodiment, the tips or free ends of the bristles 22 essentially lie in the same plane as the free end 26 of the head 18. As the head free end 26 contacts the surface to be cleaned, the ends of the bristles 22 also contact a different portion of the surface for use in agitating or engaging debris so as to better enable the tool 10 to pick up or receive the debris. In that regard, the tool 10 includes a flow control assembly 30 for controlling the spraying of a cleaning liquid to the surface being cleaned.

Figure 2:
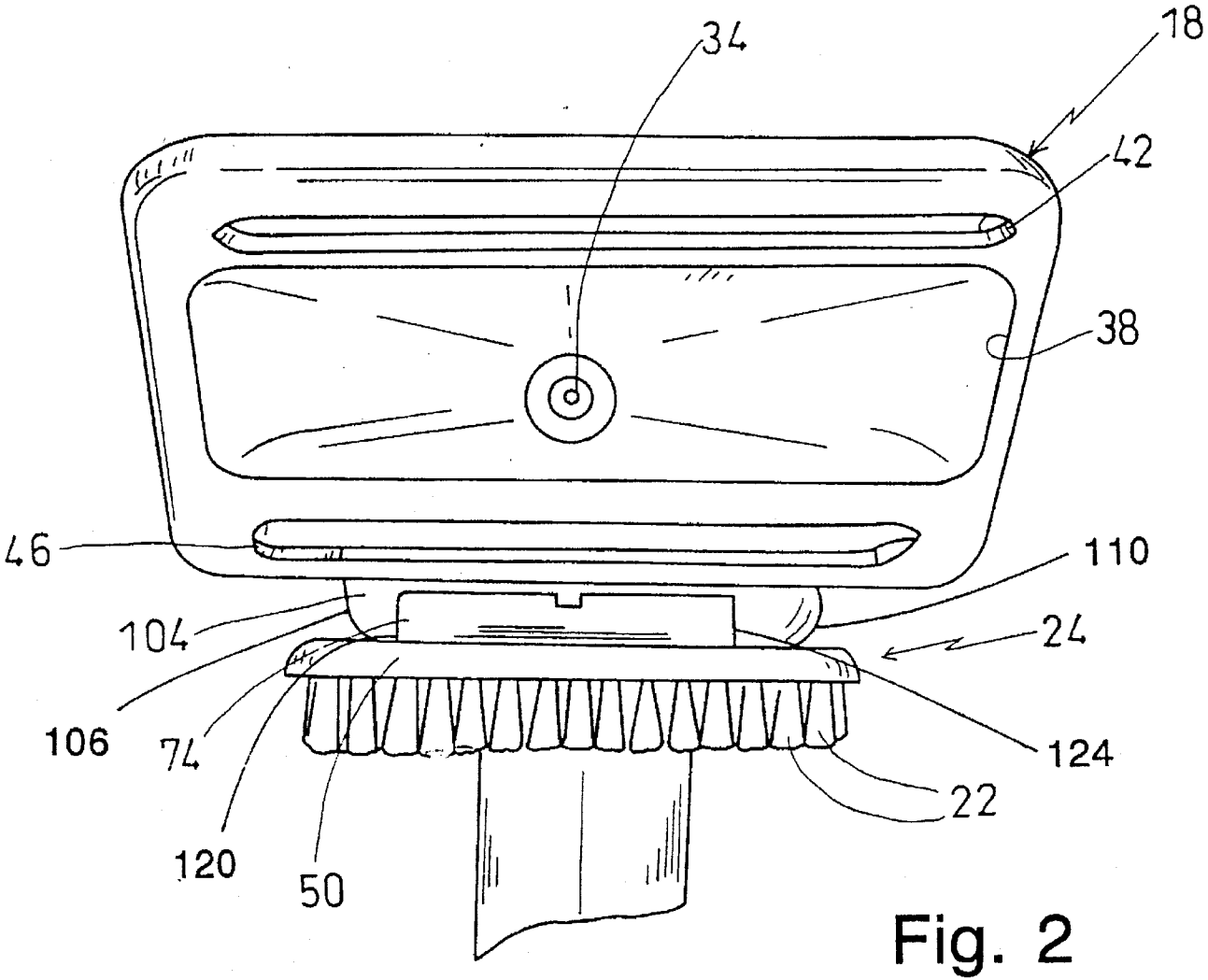
FIG. 2 is an enlarged front end view of the head of the tool.

As seen in FIG. 2, the spray control assembly 30 includes an outlet or spray nozzle 34 held in the head 18. The cleaning spray exits the spray nozzle 34 into a chamber 38 formed in the head 18 and from which it can come in contact with the surface being cleaned. In addition to this chamber 38, FIG. 2 illustrates that the head 18 also has first and second vacuum channels 42, 46. Each of these formed channels 42, 46 is isolated from the chamber 38 for providing a vacuum to receive or draw in materials on the surface being cleaned, including debris, as the head 18 moves relative to the surface.

Figure 3:
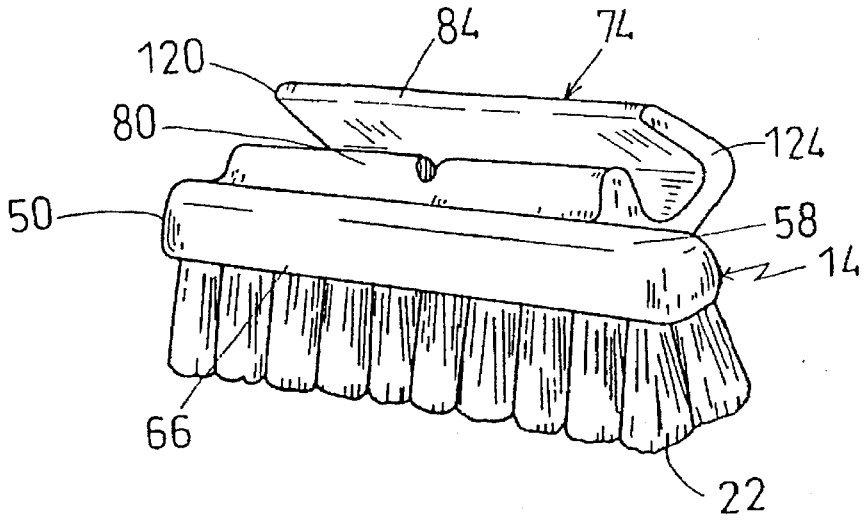
FIG. 3 is a perspective view of the cleaning brush unit.
Figure 4:
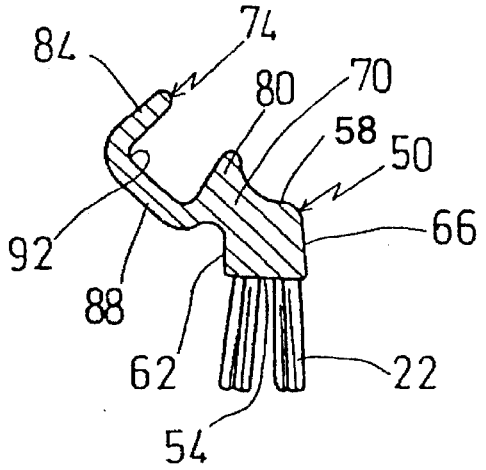
FIG. 4 is a lateral cross-sectional view of the cleaning brush unit.

The cleaning brush unit 14 is described in greater detail with reference to FIGS. 3 and 4. The cleaning brush unit 14 includes a base member 50 having a number of holes (not shown) into which the bristles 22 are received. The holes are formed in the bottom 54 of the base member 50. The base member 50 also has a top surface 58 and first and second longitudinally extending side walls 62, 66. A connector 70 extends along most of the length of the side wall 62 for integrally joining a seat or female member 74 to the base member 50. The connector 70 is integrally joined to the first side wall 62 and is disposed at an angle relative thereto. As viewed in FIG. 4, the angle formed by the connector 70 with the top surface 58 of the base member 50 is greater than 90°. This angular relationship is important in desirably locating the bristles 22 relative to the head 18 when the bristles are being used to clean the surface, as well as desirably locating the bristles 22 away from the surface to be cleaned when the cleaning brush unit 14 is in another position. The seat member 74 includes a first projection 80 that is integrally formed with the connector 70 and a second projection 84 spaced therefrom and with an intermediate member 88 interconnecting the first and second projections 80, 84 together. This arrangement of the projections 80, 84 and the intermediate member 88 define an open channel 92 for use in connecting or attaching the cleaning brush unit 14 to other portions of the tool 10. In that regard, reference is now made to FIG. 5, which illustrates this connection.

Figure 5:
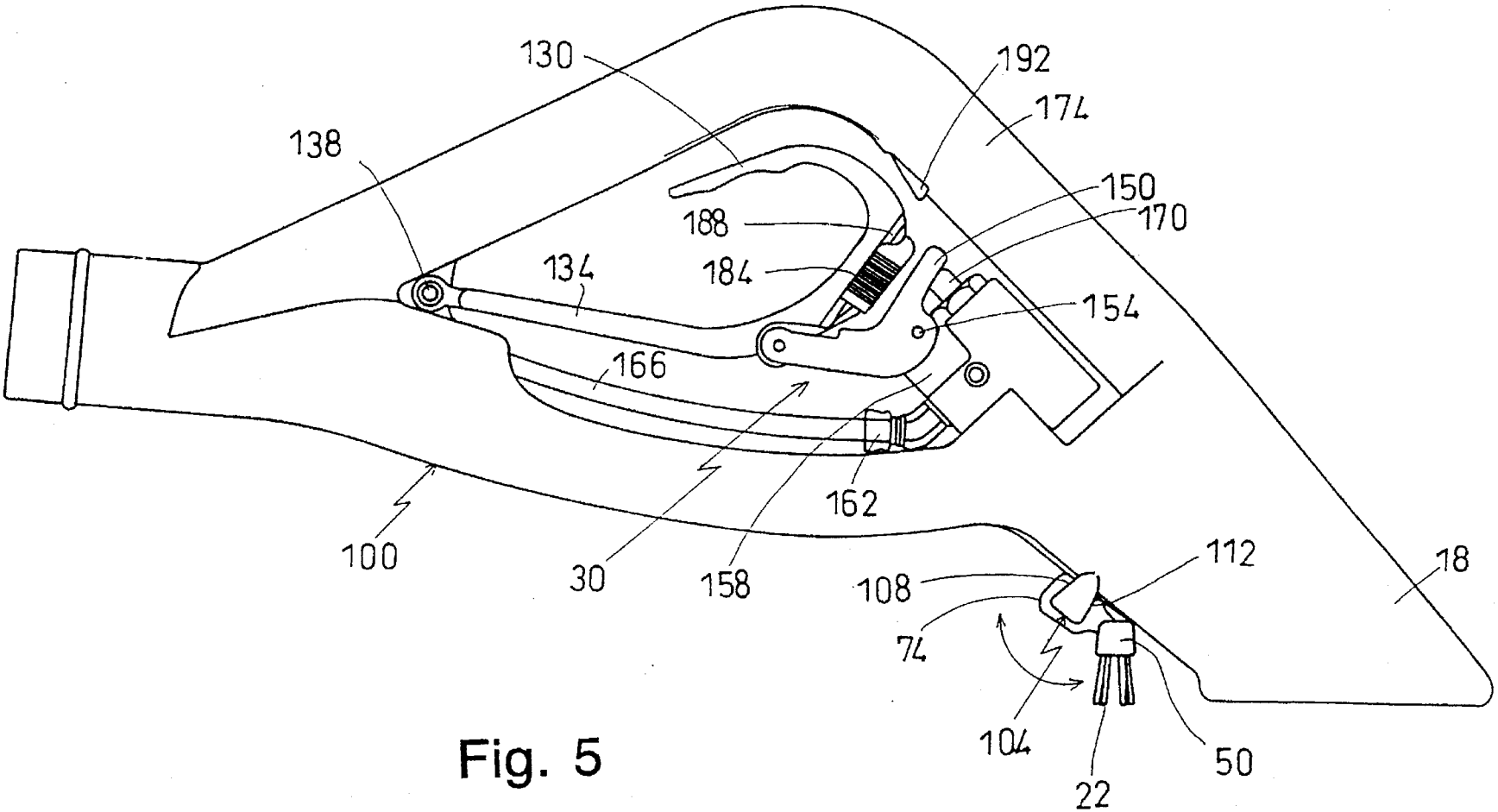
FIG. 5 is a side plan view illustrating the tool with the cleaning brush unit held in the cleaning position.

As seen in FIG. 5, the tool 10 includes a cleaning accessory tool body 100 of which the head 18 is a part thereof. Formed along an outer surface of the head 18 is a holding assembly that includes an attachment member 104 having longitudinally extending first and second side walls 108, 112 and first and second ends 106, 110. The length of each of the two side walls 108, 112 substantially corresponds to the length of the seat member 74. The first and second side walls converge in a direction outwardly to inwardly of the tool body 100. The attachment member 104 is received by the open channel 92 of the seat member 74 when the cleaning brush unit 14 is connected to the attachment member 104. In FIG. 5, the cleaning brush unit 14 is in a cleaning position in which the bristles 22 are used as part of the cleaning operation. That is, as the head 18 is moved relative to the surface being cleaned to draw in material by the vacuum being created, the bristles 22 are able to assist in the dislodging or agitation of dust, debris or other particles from upholstery or formed on the exterior of the wall surface which may be, for example, a fabric. In the disclosed embodiment, the tips or free ends of the bristles 22 are substantially in the same plane as the mouth or open end of the head 18 to facilitate the desired operation of the cleaning brush unit 14.

Figure 6:
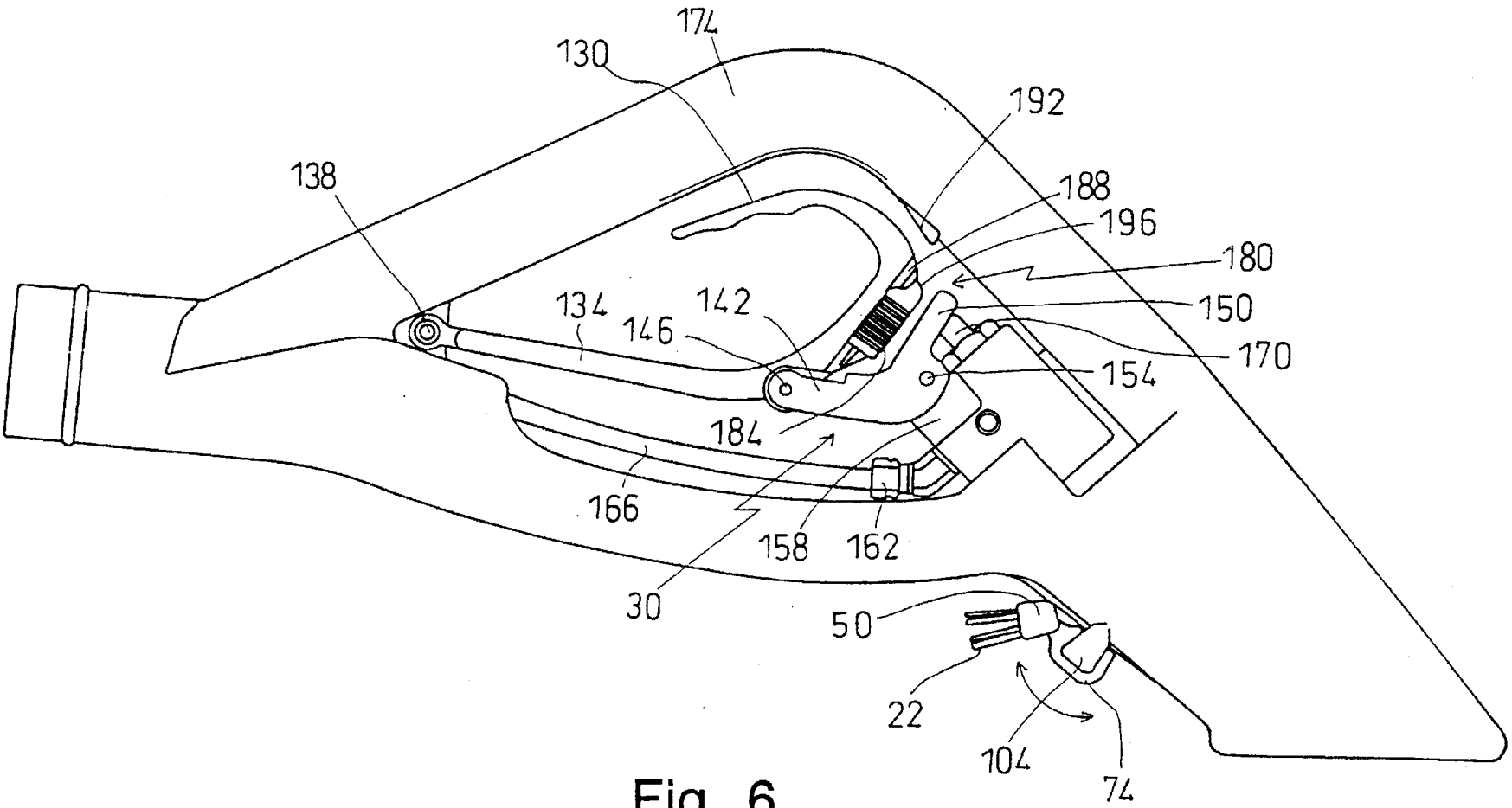
FIG. 6 is a side plan view illustrating the tool with the cleaning brush unit held in the storage position.

With reference to FIG. 6, an important characteristic of the present invention concerns the changing in position of the cleaning brush unit 14. Specifically, when it is desirable to store or otherwise not use the cleaning brush unit 14, it can be located in a storage position. In this position, the brush bristles 22 face in a direction away from the head 18 generally along the direction of the tool body 100. No contact or other engagement would occur between the brush bristles 22 and any surface being cleaned, when the tool 10 is being used to clean a surface with the cleaning brush unit 14 in this storage position.

With respect to changing positions of the cleaning brush unit 14, the seat member 74 is moved or slid relative to the first and second walls 108, 112 of the attachment member 104 in a direction into or out of the plane of FIG. 6, i.e., relative to the longitudinal extent of the side walls 108, 112 of the attachment member 104 and relative to the longitudinal extent of the first and second projections 80, 84 of the seat member 74. After removal of the cleaning brush unit 14, to change its position, it is turned or rotated 180° and then re-joined to the attachment member 104 by the same sliding operation. For example, regarding a change in the position of the cleaning brush unit 14 from the cleaning position of FIG. 5 to the storage position of FIG. 6, in the cleaning position of FIG. 5 the first end 120 of the seat member 74 is viewable in FIG. 5. When the cleaning brush unit 14 is changed from this cleaning position to the storage position of FIG. 6, the opposite or second end 124 of the seat member 74 is viewable in FIG. 6. That is, in changing from the cleaning position of FIG. 5 to the storage position of FIG. 6, the cleaning brush unit 14 is slidably removed from the attachment member 104, the cleaning brush unit 14 is turned or rotated 180° about an axis perpendicular to the length of the cleaning brush unit 14 so that the ends 120, 124 are reversed in position and then the cleaning brush unit 14 is slidably connected to the attachment member 104 so that the first end 120 of the cleaning brush unit 14 is adjacent to the second end 110 of the attachment member 104 and the second end 124 of the cleaning brush unit 14 is adjacent to the first end 106 of the attachment member 104.

With continued reference to FIGS. 5 and 6, as well as FIG. 1, the spray control assembly 30 will be described in greater detail. This assembly 30 includes a grip section 130 which can be grasped by the user or operator for use in enabling/disabling the spraying of a liquid cleaner through the spray nozzle 34 (FIG. 2). The grip section 130 is integral with a pivot section 134 that has its free end pivotally connected to the body 100 of the tool 10 by the pivot pin 138. The pivot section 134 is pivotally connected to a linkage member 142 by a linkage pin 146. An activator member 150 is joined to the linkage member 142. The activator member 150 is able to pivot or move using an activator pin 154. The activator pin 154 is joined to a valve unit 158 that includes an inlet member 162 as well as the spray nozzle 34. The inlet member 162 receives the cleaning liquid from a remote source using tubing 166. Control of the cleaning liquid from the inlet member 162 through the body of the valve unit 158 is controlled using a valve plunger 170, which is operatively engageable by the activator member 150. Specifically, upon gripping and movement of the grip section 130 in a direction towards a handle 174 of the tool body 100, a movement occurs through the linkage member 142 of the activator member 150 whereby the activator member 150 moves the valve plunger 170 inwardly to permit the cleaning liquid to exit the valve unit through the spray nozzle 34. Consequently, as the operator is using the tool to clean a surface and is engaging the tool using the handle 174 and, concomitantly, the grip section 130, cleaning liquid is being sprayed using the spray nozzle 34.

With regard to the spraying of liquid, the tool 10 has three operative states. As just explained, in a first state the operator is able to activate the spraying of liquid by engaging, and thereby pulling, the grip section 130 towards the handle 74. Upon release of the grip section 130 by the operator, liquid spray is no longer output by the spray nozzle 34. As seen in FIGS. 5 and 6, in the first state a latch member 184 is disposed approximately mid-way along a rail member 188. With respect to the other two states, the latch member 184 is in different positions.

Figure 7:
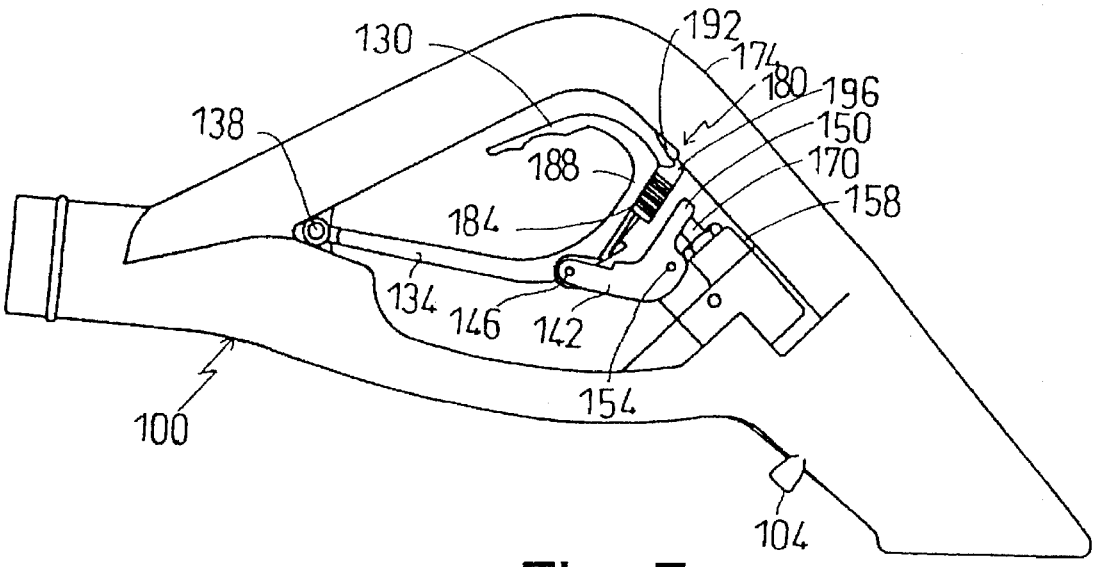
FIG. 7 is a view illustrating the first locking assembly being in a lock off position in which cleaning liquid spray is unable to exit the tool.

More particularly, with reference to FIG. 7, a second state is illustrated in which first portions of the latch member 184 are part of a first locking assembly 180. The first locking assembly 180 is used to lock the grip section 130 in place so that, upon grasping the grip section 130, there is no activation of the valve plunger 170 in an inward direction and no cleaning spray exits the spray nozzle 34. This aspect might be desirable in any case in which the operator wishes to clean a surface without spraying the liquid cleaner. The first locking assembly 180 includes a first end 196 of the sliding latch member 184 that is moveable relative to the rail member 188. The first locking assembly 180 also includes a holding ledge 192 formed on an inner wall of the tool body 100. When in the second or "lock off" state, in order to prevent spraying of cleaning liquid while the grip section 130 is being grasped, the latch member 184 is slid so that its first end 196 engages the holding ledge 192. Until the latch member 184 is slid in the opposite direction to release it from the holding ledge 192, no cleaning liquid is sprayed from the spray nozzle 34 even though the user is grasping the grip section 130.

Figure 8:
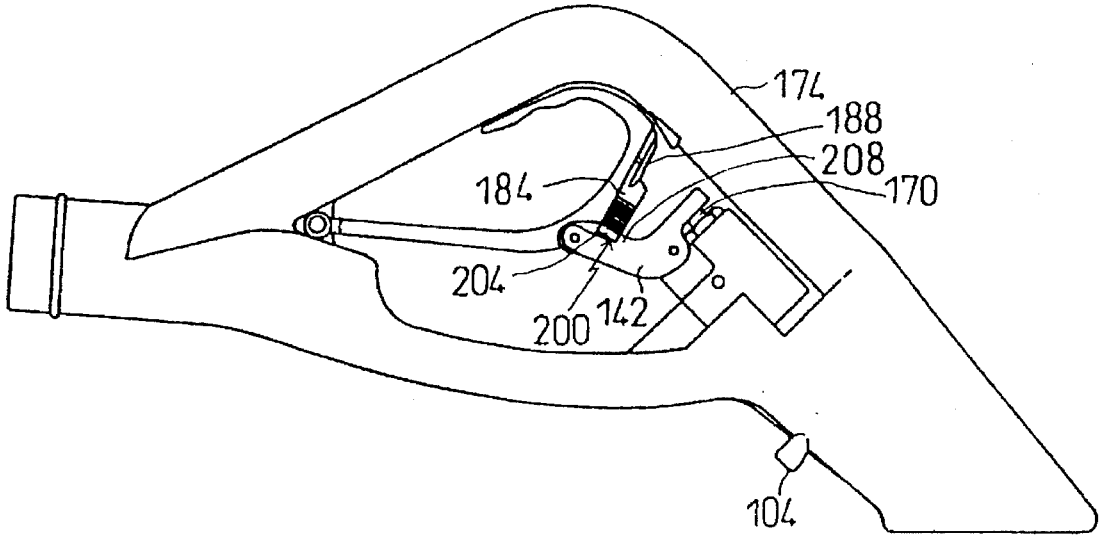
FIG. 8 is a side plan view illustrating the second locking assembly being in a lock on position in which cleaning liquid spray is able to exit the tool.

With reference to FIG. 8, a third state is illustrated in which second portions of the latch member 184 are part of a second locking assembly 200. The second locking assembly 200 is used to lock the grip section 130 in place so that the operator need not grasp the grip section 130 in order to activate the valve plunger 170 since the valve plunger 170 is activated by the second locking assembly 200. This feature might be desirable in a situation in which the operator wishes to clean a surface using the liquid spray without having to be concerned about grasping the grip section 130. The second locking assembly 200 includes a second end 204 of the sliding latch member 184 that is moveable relative to the rail member 188. The second locking assembly 200 also includes a locking ridge 208 formed on the linkage member 142. When in this third or "lock on" state, in order to enable spraying of the cleaning liquid even when the grip section 130 is not being grasped, the latch member 184 is slid so that its second end 204 engages the locking ridge 208. Until the latch member 184 is slid in the opposite direction to release it from the locking ridge 208, cleaning liquid is sprayed from the spray nozzle 34 even though the user or operator is not grasping the grip section 130.

The foregoing discussion of the invention, including any variations thereof, has been presented for purposes of illustration and description. It is not intended that any such embodiment be exhaustive or in any way limit the invention to the precise form disclosed. Other modifications and variations may be possible in light of the above teachings. It is intended that the appended claims be construed to include other alternative embodiments of the invention except insofar as limited by the prior art.

What is claimed is:

1. A cleaning tool with brush storage, comprising:

a body having a head with at least a first passageway for carrying debris from a surface being cleaned;

a cleaning brush unit including brush bristles to be held to said body; and means connected to said body for holding said cleaning brush unit in a selected one of a cleaning position and a storage position wherein, when said cleaning brush unit is located in said storage position, said brush bristles face in a direction different from when said cleaning brush unit is in said cleaning position;

wherein said cleaning brush unit has a first end and a second end and said means for holding has a first end and a second end, with said first end of said cleaning brush unit being located adjacent to said first end of said means for holding when said cleaning brush unit is in said cleaning position and said first end of said cleaning brush unit being located adjacent to said second end of said means for holding when said cleaning brush unit is in said storage position.

2. A tool, as claimed in claim 1, wherein:

said head includes a chamber for delivering a cleaning liquid that is supplied to the surface being cleaned.

3. A tool, as claimed in claim 1, wherein:

said cleaning brush unit includes a base member to which said brush bristles are joined and a connector, said connector being disposed at an angle relative to said base member.

4. A tool, as claimed in claim 3, wherein:

said connector is integral with said base member.

5. A tool, as claimed in claim 1, wherein:

when said cleaning brush unit is in said storage position, said brush bristles face in a direction away from said head.

6. A tool, as claimed in claim 1, wherein:

said means for holding includes an attachment member having first and second walls and said attachment member is slidably joined to said cleaning brush unit.

7. A tool, as claimed in claim 1, further including:

a spray control assembly for controlling the delivery of a liquid cleaner spray, said spray control assembly including a locking assembly for disabling the spraying of the liquid cleaner from said spray control assembly.

8. A tool, as claimed in claim 1, further including:

a spray control assembly for controlling the delivery of a liquid cleaner spray, said spray control assembly including a locking assembly for enabling the spraying of the liquid cleaner from said spray control assembly.

9. A tool, as claimed in claim 1, wherein:

said body is an integral, one-piece construction.

10. A cleaning tool with brush storage, comprising:

a body having a head with at least a first passageway for carrying debris from a surface being cleaned;

a cleaning brush unit including brush bristles to be attached to said body, said cleaning brush unit including a base member to which said brush bristles are joined at a connector, said connector being disposed at an angle relative to said base member and in which said angle is different from 90 degrees; and means connected to said body for holding said cleaning brush unit in a selected one of a cleaning position and a storage position wherein, when said cleaning brush unit is located in said storage position, said brush bristles face in a direction different from when said cleaning brush unit is in said cleaning position.

11. A cleaning tool with brush storage, comprising:

a body having a head with at least a first passageway for carrying debris from a surface being cleaned;

a cleaning brush unit including brush bristles to be attached to said body, said cleaning brush unit including a seat member; and means connected to said body for holding said cleaning brush unit in a selected one of a cleaning position and a storage position wherein, when said cleaning brush unit is located in said storage position, said brush bristles face in a direction different from when said cleaning brush unit is in said cleaning position and in which said means for holding includes an attachment member and in which said seat member slidably moves relative to said attachment member for positioning said cleaning brush unit.

12. A cleaning tool with brush storage, comprising:

a body having a head with at least a first passageway for carrying debris from a surface being cleaned;

a cleaning brush unit including brush bristles to be held to said body; and means connected to said body for holding said cleaning brush unit in a selected one of a cleaning position and a storage position wherein, when said cleaning brush unit is located in said storage position, said brush bristles face in a direction different from when said cleaning brush unit is in said cleaning position; and a spray control assembly for controlling the delivery of a liquid cleaner spray, said spray control assembly including a locking assembly for disabling the spraying of the liquid cleaner from said spray control assembly, said locking assembly including a slidable latch member and a holding ledge and in which said latch member engages said holding ledge for use in preventing the spraying of the liquid cleaner.

13. A cleaning tool with brush storage, comprising:

a body having a head with at least a first passageway for carrying debris from a surface being cleaned;

a cleaning brush unit including brush bristles to be held to said body;

means connected to said body for holding said cleaning brush unit in a selected one of a cleaning position and a storage position wherein, when said cleaning brush unit is located in said storage position, said brush bristles face in a direction different from when said cleaning brush unit is in said cleaning position; and a spray control assembly for controlling the delivery of a liquid cleaner spray, said spray control assembly including a locking assembly for enabling the spraying of the liquid cleaner from said spray control assembly, said locking assembly including a slidable latch member and a locking ridge and in which said latch member engages said locking ridge for use in enabling the spraying of the liquid cleaner.

14. A cleaning tool with brush storage, comprising:

a body having a head with at least a first passageway for carrying debris from a surface being cleaned;

a cleaning brush unit including brush bristles to be held to said body;

means connected to said body for holding said cleaning brush unit; and a spray control assembly for controlling the delivery of a liquid cleaner spray, said spray control assembly including a locking assembly for disabling and enabling the spraying of the liquid cleaner from said spray control assembly, said locking assembly including a common element moveable in a substantially linear direction including being moveable between first and second positions and in which said common element is in said first position , when spraying of the liquid cleaner is continuously disabled and, after movement of said common element to said second position, the spraying of the liquid cleaner is enabled continuously.

* * * * *